US007486245B2

(12) United States Patent
Park et al.

(10) Patent No.: US 7,486,245 B2
(45) Date of Patent: Feb. 3, 2009

(54) MOBILE TERMINAL WITH PLURAL ANTENNAS

(75) Inventors: Se-hyun Park, Suwon-si (KR); Byung-tae Yoon, Suwon-si (KR); Young-eil Kim, Suwon-si (KR); Seong-soo Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/522,966

(22) Filed: Sep. 19, 2006

(65) Prior Publication Data

US 2007/0139281 A1 Jun. 21, 2007

(30) Foreign Application Priority Data

Dec. 16, 2005 (KR) ..... 10-2005-0124851

(51) Int. Cl.
*H01Q 1/24* (2006.01)

(52) U.S. Cl. ..... 343/702; 343/725; 343/700 MS; 343/846

(58) Field of Classification Search ..... 343/702, 343/700 MS, 725, 846
See application file for complete search history.

(56) References Cited

U.S. PATENT DOCUMENTS

| | | | | |
|---|---|---|---|---|
| 5,929,813 | A | 7/1999 | Eggleston | |
| 6,201,501 | B1 | 3/2001 | Arkko et al. | |
| 6,697,020 | B2 * | 2/2004 | Ying | 343/702 |
| 7,069,043 | B2 * | 6/2006 | Sawamura et al. | 455/550.1 |
| 7,129,898 | B1 * | 10/2006 | Chou | 343/700 MS |
| 7,162,264 | B2 * | 1/2007 | Vance | 455/550.1 |
| 2005/0024272 | A1 | 2/2005 | Ponce de Leon et al. | |

FOREIGN PATENT DOCUMENTS

| | | |
|---|---|---|
| EP | 1324425 A1 | 7/2003 |
| KR | 2001-0052175 | 6/2001 |

* cited by examiner

*Primary Examiner*—Hoang V Nguyen
(74) *Attorney, Agent, or Firm*—Sughrue Mion, PLLC

(57) ABSTRACT

Disclosed is a mobile terminal with plural antennas. The mobile terminal with plural antennas, comprising a circuit board formed with a variety of elements, at least one first antenna formed on one surface of the circuit board to transmit and receive a radio signal for mobile communications, and at least one second antenna formed on the other surface of the circuit board to transmit and receive a radio signal for additional services. Accordingly, as the size of the mobile terminal does not necessarily increase to have plural antennas, the mobile terminal can be miniaturized.

10 Claims, 2 Drawing Sheets

MOBILE TERMINAL WITH PLURAL ANTENNAS

CROSS-REFERENCE TO RELATED APPLICATIONS

This application claims benefit under 35 U.S.C. §119(a) of Korean Patent Application No. 2005-124851, filed Dec. 16, 2005 in the Korean Intellectual Property Office, the entire contents of which are incorporated herein by reference.

BACKGROUND OF THE INVENTION

1. Field of the invention

The present invention relates to a mobile terminal with plural antennas. More particularly, the present invention relates to a mobile terminal of a certain size with plural antennas.

2. Description of the Related Art

Recently, as the functions of a mobile terminal are diversified, mobile terminals provide diverse services such as wireless Internet connections, digital multimedia broadcasting (DMB) for viewing programs of terrestrial and satellite origin, global positioning system (GPS) receivers, camera, MP3 players, and, radio frequency identification systems (RFID), as well as the communications function.

To use the diverse additional functions other than communications, multi-band mobile terminals are being developed, and to implement the multi-band mobile terminals, an antenna capable of transmitting and receiving a multi-band radio signal is needed. Such antennae may require features such as compact size, broad bandwidth and high gain.

In general, a mobile terminal is mounted with an external antenna or an internal antenna. A mono-pole antenna and a helical antenna are mainly used as external antennae, and a planar inverted F antenna (PIFA) is mainly used as internal antennae.

The mono pole antenna and the helical antenna are externally exposed so that the antenna can be damaged by an external impact. When a user uses the mobile terminal, the antenna is often located around the head of the user so that electromagnetic waves can possibly have a bad effect on the user.

To solve weakness of the external antenna, the PIFA internal antenna is often used.

Referring to FIG. 1, the PIFA 10 is implemented as a three-dimensional structure including a ground 5, a radiation part 11, a feeding part 15 and a short part 13.

The radiation part 11 is formed on the upper part of the ground 5, and the short part 13 is formed at the edge of the radiation part 11 to connect the ground 5 and the radiation part 11. The feeding part 15 supplies an electric current to the radiation part 11. Generally, impedance matching is determined according to the location of the short part 13 and the length of the feeding part 15.

As such, the PIFA 10 is an internal antenna which can be embedded in a mobile terminal, the weakpoints of the external antenna can be essentially solved, and manufacturing the internal antenna is easier than the external antenna. However, the PIFA 10 has the limit to miniaturization due to a gap between the radiation part 11 and the ground 5.

Meanwhile, to support functions, such as DMB, GPS and RFID, provided in different frequency bands, respectively, separate antennas are required. However, if the mobile terminal is mounted with plural PIFA antennas to support such functions, the size of the mobile terminal gets larger or the number of the PIFAs mounted in the mobile terminal is limited due to lack of space.

Recently, a planar antenna has been suggested for mobile communications. The planar antenna can be formed on the printed circuit board (PCB) so that extra space to place the antenna is rarely needed. However, because of the nature of the planar antenna, it is difficult to use with directional services so that it can not be put to practical use for mobile communications.

SUMMARY OF THE INVENTION

An aspect of the present invention is to solve at least the above problems and/or disadvantages and to provide at least the advantages described below. Accordingly, an aspect of the present invention is to provide a mobile terminal of a certain size with plural antennas.

In order to achieve the above-described aspects of the present invention, there is provided a mobile terminal with plural antennas, comprising a circuit board formed with a variety of elements, at least one first antenna formed on one surface of the circuit board to transmit and receive a radio signal for mobile communications, and at least one second antenna formed on the other surface of the circuit board to transmit and receive a radio signal for additional services.

The first antenna and second antenna may be planar antennas.

The first antenna may be at least one of a planar inverted F antenna (PIFA) and a patch antenna.

The second antenna may be at least one of the PIFA and the patch antenna.

The PIFA can comprise a radiation part for transmitting and receiving the radio signal for mobile communications, a feeding part for supplying an electric current to the radiation part, a ground, and a short part for connecting the radiation part and ground.

The patch antenna can comprise a radiation part, which is plate-shaped, for transmitting and receiving the radio signal, a feed point for supplying the electric current to the radiation part, and a strip line for connecting the radiation part and ground.

The first antenna may be the PIFA and the second antenna is the patch antenna.

The PIFA can be formed on one side of one surface of the circuit board, and the patch antenna is formed on the rear surface of the circuit board corresponding to where the PIFA is formed.

BRIEF DESCRIPTION OF THE DRAWING FIGURES

The above aspect and other features of the present invention will become more apparent by describing in detail exemplary embodiments thereof with reference to the attached drawing figures, wherein.

DETAILED DESCRIPTION OF THE EXEMPLARY EMBODIMENTS

Figure 1:
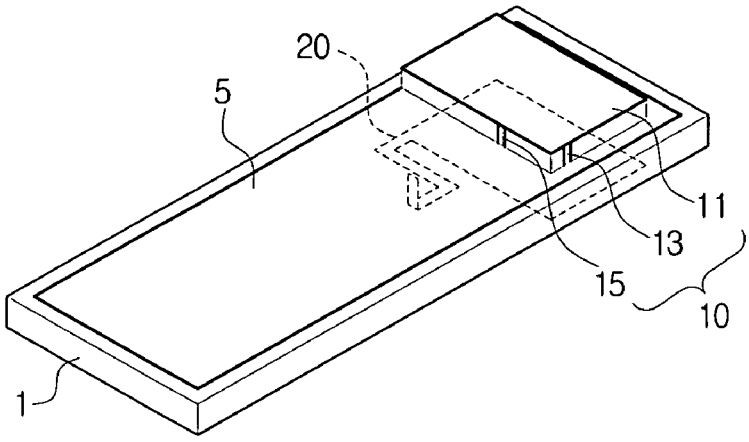
FIG. 1 is a perspective showing a circuit board of a mobile terminal with plural antennas according to an embodiment of the present invention.

Hereinafter, an embodiment of the present invention will be described in detail with reference to the accompanying drawing figures.

In the following description, the same drawing reference numerals are used for the same elements throughout the drawings. The detailed construction and elements are provided to assist in a comprehensive understanding of the invention. Thus, it is apparent that the present invention can be carried out without these details. Also, well-known functions or constructions are not described in detail since they would obscure the invention in unnecessary detail.

A mobile terminal according to the present invention has plural internal antennas and the plural internal antennas are formed on both surfaces of a circuit board.

Each antenna is implemented as a planar antenna "Planar antenna" as used herein refers to planar or thin three-dimensional antennas. There are typically the 3D PIFA, PIFA, and patch antennas.

Figure 2:
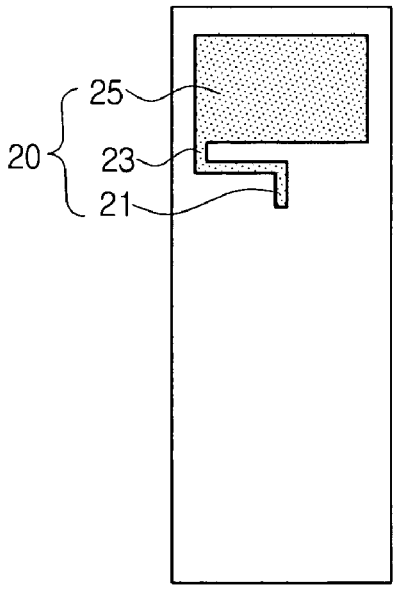
FIG. 2 shows a cross sectional view of the circuit board of FIG. 1.

FIG. 1 is a perspective showing a circuit board of a mobile terminal with plural antennas according to an embodiment of the present invention, and FIG. 2 shows a cross sectional view of the circuit board of FIG. 1.

As shown in FIGS. 1 and 2, a circuit board 1 has a first antenna of the 3D PIFA type 10 on one surface and a second antenna of the patch type 20 on the other surface.

The 3D PIFA 10 includes a ground 5, a radiation part 11, a feeding part 15, and a short part 13.

The radiation part 11 converts an electric current into a radio wave, and is plate-shaped. In FIG. 1, the radiation part 11 is illustrated as a square plate but it can be also formed with a diamond shape or a round shape and can be designed to have diverse patterns using slits.

The feeding part 15 is perpendicularly connected with the radiation part 11 to connect the radiation part 11 and the circuit board 1. The feeding part 15 transmits the electric current supplied from the circuit board 1 to the radiation part 11 so that the radiation part 11 can transmit or receive the radio wave.

The short part 13 is formed parallel to the feeding part 15 to connect the radiation part 11 and the ground 5. The short part 13 guides the electric current circulated in the radiation part 11 to the ground 5.

Due to the feeding part 15 and the short part 13, the radiation part 11 is distanced by a predetermined width from the circuit board 1.

The ground 5 is formed on the circuit board 1 and can be designed in diverse patterns according to the nature of the 3D PIFA 10 and the patch antenna 20, and desired operation band. That is, the pattern of the ground 5 can be implemented to optimize the the S-parameters S11 of the 3D PIFA 10, S11 of the patch antenna 20, and S12 between the 3D PIFA 10 and the patch antenna 20.

Hereinafter, the operation process of the 3D PIFA 10 will be described. An electric current is supplied to the radiation part 11 through the feeding part 15, and the radiation part 11 converts the electric current into a radio wave and radiates the radio wave. The electric current returns to the ground 5 through the short part 13. The radio wave externally received through the radiation part 11 is supplied to the circuit board 1 through the ground 5.

The 3D PIFA 10 is omni-directional and is used to transmit and receive a radio signal for mobile communications.

Meanwhile, the performance of the 3D PIFA 10 depends on the bandwidth, return loss in the resonant frequency and impedance matching efficiency. In general, impedance matching is determined according to the location of the short part 13 and the length of the feeding part 15.

Figure 3:
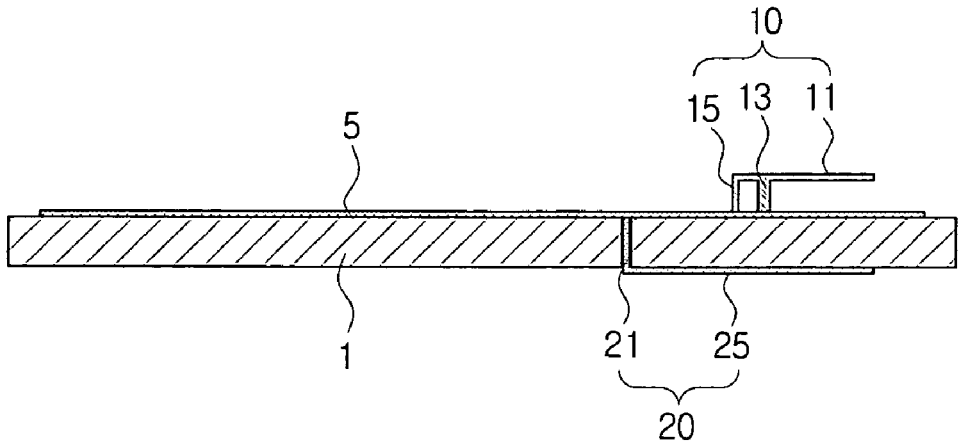
FIG. 3 shows a rear view of the circuit board of FIG. 1.

FIG. 3 shows a rear view of the circuit board of FIG. 1. Referring to FIG. 3, a patch antenna 20, a kind of a planar antenna, is formed on the rear surface of the circuit board 1.

The patch antenna 20 includes a radiation part 25, a feed point 23, a strip line 21, and the ground 5.

As shown in FIG. 2, the radiation part 25 is square-plate-shaped, but also can be formed in a round shape. Additionally, the radiation part 25 can be designed to have diverse patterns using slits and the pattern can vary the operation band of the antenna.

The strip line 21 is formed as a line extended from one side of the radiation part 25 and can have plural bent parts according to the operation nature of the antenna. The length of the strip line 21 is designed in order for the radiation part 25 to resonate by matching the real number part of the impedance to 50Ω.

The tip of the strip line 21 is vertically bent to penetrate the circuit board 1, and is connected with the ground 5 of the 3D PIFA 10. Therefore, the patch antenna 20 does not need a separate ground 5 so that the configuration of the patch antenna 20 can be simplified.

The feed point 23 is formed at the other end of the strip line 21 extended from the radiation part 25 to supply an electric current to the radiation part 25.

The patch antenna 20 is formed on the rear of the circuit board 1 corresponding to where the 3D PIFA 10 is formed. However, the patch antenna 20 can also be formed anywhere on the rear of the circuit board 1.

The 3D PIFA 10 transmits and receives radio signals for mobile communications, whereas the patch antenna 20 can transmit and receive the RFID radio signals, GPS satellite signals and DMB radio signals. The patch antenna 20 is directional to the front surface of the radiation part 25.

Recently, the mobile RFID (mRFID), combining the RFID system and mobile telecommunications, are being provided. By mounting an electronic tag, reader, antenna and processing module in a mobile terminal, the mobile terminal can read information from another electronic tag for user information service or can transmit information to another device through the electronic tag. As an RFID antenna used in mRFID transmits and receives a radio signal in the 908.5~914 MHz band, the patch antenna 20 can be used for the RFID antenna by matching the operation band of the patch antenna 20 with the frequency band of the RFID radio signal.

Meanwhile, the GPS satellite system determines the location of a mobile terminal by communicating radio signals with the mobile terminal. So, for communication with the GPS satellite system, the operation band of the antenna of the mobile terminal has to be matched with the frequency band of the GPS satellite signal (L2 band: 1227.6 MHz, L1 band: 1575.42 MHz). Accordingly, the patch antenna 20 can be used for the GPS antenna by matching the operation band of the patch antenna 20 with the frequency band of the GPS satellite system signal.

The DMB service is divided into the satellite based DMB service and the DMB service. The satellite DMB service uses the S-band at 2.630~2.655 GHz which is higher than the terrestrial DMB band. The terrestrial DMB service uses the frequency band at 204~210 MHz. Accordingly, the patch antenna 20 can be used for the satellite DMB or terrestrial DMB by matching the operation band of the patch antenna 20 with the corresponding frequency band.

Meanwhile, in the above embodiment, the 3D PIFA 10 is used for mobile communications, and the patch antenna 20 is used for the RFID, GPS and/or DMB services. However, the 3D PIFA 10 can of course be used for the RFID, GPS and/or DMB services, and the patch antenna 20 for mobile communications.

Further, unlike the above embodiment, one or more patch antennas can be formed on both surfaces of the circuit board 1.

As can be appreciated from the above description, the mobile terminal of a certain size according to an embodiment of the present invention can have plural antennas by forming the 3D PIFA antenna and the patch antenna on opposite surfaces of the circuit board. Accordingly, as the size of the mobile terminal does not necessarily have to increase to have plural antennas, the mobile terminal can be miniaturized.

While the invention has been shown and described with reference to certain embodiments thereof, it will be understood by those skilled in the art that various changes in form and details may be made therein without departing from the spirit and scope of the invention as defined by the appended claims.

What is claimed is:

1. A mobile terminal with plural antennas, comprising:

a circuit board formed with a variety of elements;

at least one first antenna disposed on one surface of the circuit board to transmit and receive a first radio signal for mobile communications; and at least one second antenna disposed on another surface of the circuit board to transmit and receive a second radio signal for additional services, wherein a ground of the at least one first antenna is disposed on the one surface of the circuit board, and a first radiation part of the at least one first antenna is disposed above the ground of the at least one first antenna, wherein a second radiation part of the at least one second antenna is disposed directly on the other surface of the circuit board.

2. The mobile terminal of claim 1, wherein the at least one first antenna and the at least one second antenna are planar antennas.

3. The mobile terminal of claim 2, wherein the at least one first antenna is at least one of a planar inverted F antenna (PIFA) and a patch antenna.

4. The mobile terminal of claim 3, wherein the at least one second antenna is at least one of the PIFA and the patch antenna.

5. The mobile terminal of claim 4, wherein the PIFA comprises a PIFA radiation part for transmitting and receiving radio signals, a feeding part for supplying an electric current to the PIFA radiation part, a PIFA ground, and a short part for connecting the PIFA radiation part and the PIFA ground.

6. The mobile terminal of claim 4, wherein the patch antenna comprises a patch radiation part, which is plate-shaped, for transmitting and receiving radio signals, a feed point for supplying the electric current to the patch radiation part, and a strip line for connecting the patch radiation part and the PIFA ground.

7. The mobile terminal of claim 6, wherein a tip of the strip line is vertically bent to penetrate the circuit board to connect the second radiation part of the patch antenna to the ground of the PIFA.

8. A mobile terminal with plural antennas, the mobile terminal comprising:

a circuit board formed with a variety of elements;

at least one first antenna disposed on one surface of the circuit board to transmit and receive a first radio signal for mobile communications; and at least one second antenna disposed on another surface of the circuit board to transmit and receive a second radio signal for additional services, wherein a radiation part of the at least one second antenna is disposed directly on the other surface of the circuit board, and wherein the at least one first antenna is a planar inverted F antenna (PIFA) and the at least one second antenna is a patch antenna.

9. The mobile terminal of claim 8, wherein the PIFA is disposed on one side of the one surface of the circuit board, and the another surface on which the patch antenna is disposed is a rear surface of the circuit board corresponding to where the PIFA is formed.

10. A mobile terminal with plural antennas, comprising:

a circuit board formed with a variety of elements;

at least one first antenna disposed on one surface of the circuit board to transmit and receive a first radio signal for mobile communications; and at least one second antenna disposed on another surface of the circuit board to transmit and receive a second radio signal for additional services, wherein the at least one second antenna is connected to a ground of the at least one first antenna via a path penetrating through the circuit board, wherein the ground of the at least one first antenna is disposed on the one surface of the circuit board.

* * * * *